US007600524B2

(12) United States Patent
West

(10) Patent No.: US 7,600,524 B2
(45) Date of Patent: Oct. 13, 2009

(54) MONO-CRUTCH FOR LOWER LEG DISABILITY

(75) Inventor: Phillip B. West, Idaho Falls, ID (US)

(73) Assignees: West Effective Solutions and Technology, LLC, Idaho Falls, ID (US); Idaho Foot Center, P.C., Idaho Falls, ID (US)

( * ) Notice: Subject to any disclaimer, the term of this patent is extended or adjusted under 35 U.S.C. 154(b) by 119 days.

(21) Appl. No.: 11/965,224

(22) Filed: Dec. 27, 2007

(65) Prior Publication Data

US 2009/0165834 A1 Jul. 2, 2009

(51) Int. Cl.
*A61H 3/02* (2006.01)
*A63B 25/00* (2006.01)

(52) U.S. Cl. ..... 135/71; 135/69; 135/73; 602/16; 623/28; 482/75

(58) Field of Classification Search ..... 135/65–66, 135/68–69, 71, 73–74; 482/75; 602/5, 16, 602/23, 26–27; 623/27–28, 32, 36, 38–39
See application file for complete search history.

(56) References Cited

U.S. PATENT DOCUMENTS

| | | | | | |
|---|---|---|---|---|---|
| 2,778,370 | A | * | 1/1957 | Chamblee | 135/68 |
| 2,827,897 | A | * | 3/1958 | Pawlowski | 602/16 |
| 2,832,079 | A | * | 4/1958 | Bailey | 623/28 |
| 4,058,119 | A | | 11/1977 | Rosequist | |
| 4,141,375 | A | * | 2/1979 | Tykwinski | 135/66 |
| 4,291,715 | A | | 9/1981 | Monte | |
| D291,148 | S | * | 8/1987 | Rizzo | D3/7 |
| 4,910,927 | A | | 3/1990 | Beatty | |
| 5,178,595 | A | * | 1/1993 | MacGregor | 482/75 |
| 5,498,220 | A | * | 3/1996 | Ensmenger | 482/76 |
| 5,575,299 | A | | 11/1996 | Bieri | |
| 5,645,515 | A | * | 7/1997 | Armstrong et al. | 482/75 |
| 5,746,236 | A | | 5/1998 | Tilsley et al. | |
| 5,941,263 | A | | 8/1999 | Bierman | |
| 6,494,919 | B1 | * | 12/2002 | Matthews | 623/32 |
| 6,517,586 | B2 | * | 2/2003 | Lin | 623/28 |
| 6,648,803 | B1 | * | 11/2003 | Jay | 482/76 |
| 6,799,592 | B1 | | 10/2004 | Reynolds | |
| 7,108,640 | B2 | * | 9/2006 | Emmert | 482/75 |
| 7,303,537 | B1 | * | 12/2007 | Snyder et al. | 602/16 |

FOREIGN PATENT DOCUMENTS

| | | |
|---|---|---|
| CA | 2284952 | 10/1999 |
| CA | 2326678 | 10/1999 |

* cited by examiner

*Primary Examiner*—Winnie Yip
(74) *Attorney, Agent, or Firm*—Stephen M. Nipper; Dykas, Shaver & Nipper, LLP

(57) ABSTRACT

A mono-crutch for assisting the ambulation of individuals having injured or otherwise debilitated lower extremities. The mono-crutch having upper leg support with inner and outer support pads, a lower leg support for cradling a wearer's lower leg, and a ground contact member. The inner and outer support pads are configured so as to be able to be swapped or raised/lowered relative to one another, thereby allowing both right legged and left legged configurations to be created using the same mono-crutch.

20 Claims, 4 Drawing Sheets

MONO-CRUTCH FOR LOWER LEG DISABILITY

FIELD OF THE INVENTION

The invention relates generally to medical ambulatory aids and more particularly relates to a partial crutch that can be connected to a user's leg.

BACKGROUND OF THE INVENTION

Frequently, individuals will injure or otherwise experience a debilitation of their lower extremities. For instance, a user may sprain an ankle or break a bone in his/her foot. While some such injuries may allow an individual to wear a "walking cast," more often than not the injured person is prescribed a pair of crutches or other such ambulatory device. These crutches allowing the injured person to be mobile and stay involved in daily life (work obligations, family, etc.) with out the need for a wheel chair. Additionally, such ambulatory devices are frequently used by below knee (BK) amputees who can't afford or are otherwise between prosthetics.

Existing crutches for temporary and sometimes long term use are one of two types. The first type uses an underarm pad and handles at near waist level. The user's weight is placed on either of the hands, underarms or both. The other type uses some amount of loading on feed and most of the loading on the hands with braces engaging the forearm. Both are awkward and require (predominantly) both hands. Typically, the incapacitated lower leg must be held elevated by the users, with bending at the knee, causing fatigue.

Knee or "mono" crutches are also shown in the prior art. For instance, U.S. Pat. No. 6,799,592 (Reynolds), U.S. Pat. No. 4,910,927 (Beatty), U.S. Pat. No. 5,575,299 (Bieri), U.S. Pat. No. 5,941,263 (Bierman) and U.S. Pat. No. 4,058,119 (Rosequist). Such devices typically allowing a user to place a full load on their injured side of the body while supporting the disabled lower leg portion at an elevated position behind the user.

SUMMARY OF THE INVENTION

This summary relates to one embodiment of the present invention. One embodiment of the present invention is a mono-crutch for lower leg disability. This "mono-crutch" configured for attaching to and supporting a user's leg having an upper and lower leg portion. The mono-crutch comprising an upper leg support, a lower leg support, and a ground contact member.

In this embodiment, the upper leg support is configured for attachment to the user's upper leg portion. The upper leg support comprising a pair of opposing thigh pad portions, namely an upper thigh pad portion and a lower thigh pad portion. The lower thigh pad portion having an upper end. Preferably, the thigh pad portions are staggered relative to one another so at least a portion of the upper thigh pad portion extends vertically higher than the upper end of the lower thigh pad portion. It is preferred the upper leg support also comprise at least one releasable adjustment for allowing the upper leg support to be attached to a user's upper leg portion.

In this embodiment, the lower leg support is configured for attachment to the user's lower leg portion. The lower leg portion comprising at least one contoured support for cradling the user's lower leg portion, the user's leg held therein through use of at least one releasable adjustment.

In this embodiment, the ground contact member is configured for contacting a ground surface, such as a floor. The ground contact member is generally perpendicular to the lower leg support and has an upper leg portion that is configured for attachment to the upper leg support.

Still other features and advantages of the present invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the drawings and description of the preferred embodiments are to be regarded as illustrative in nature, and not as restrictive in nature.

DESCRIPTION OF THE PREFERRED EMBODIMENTS

Figure 1A:
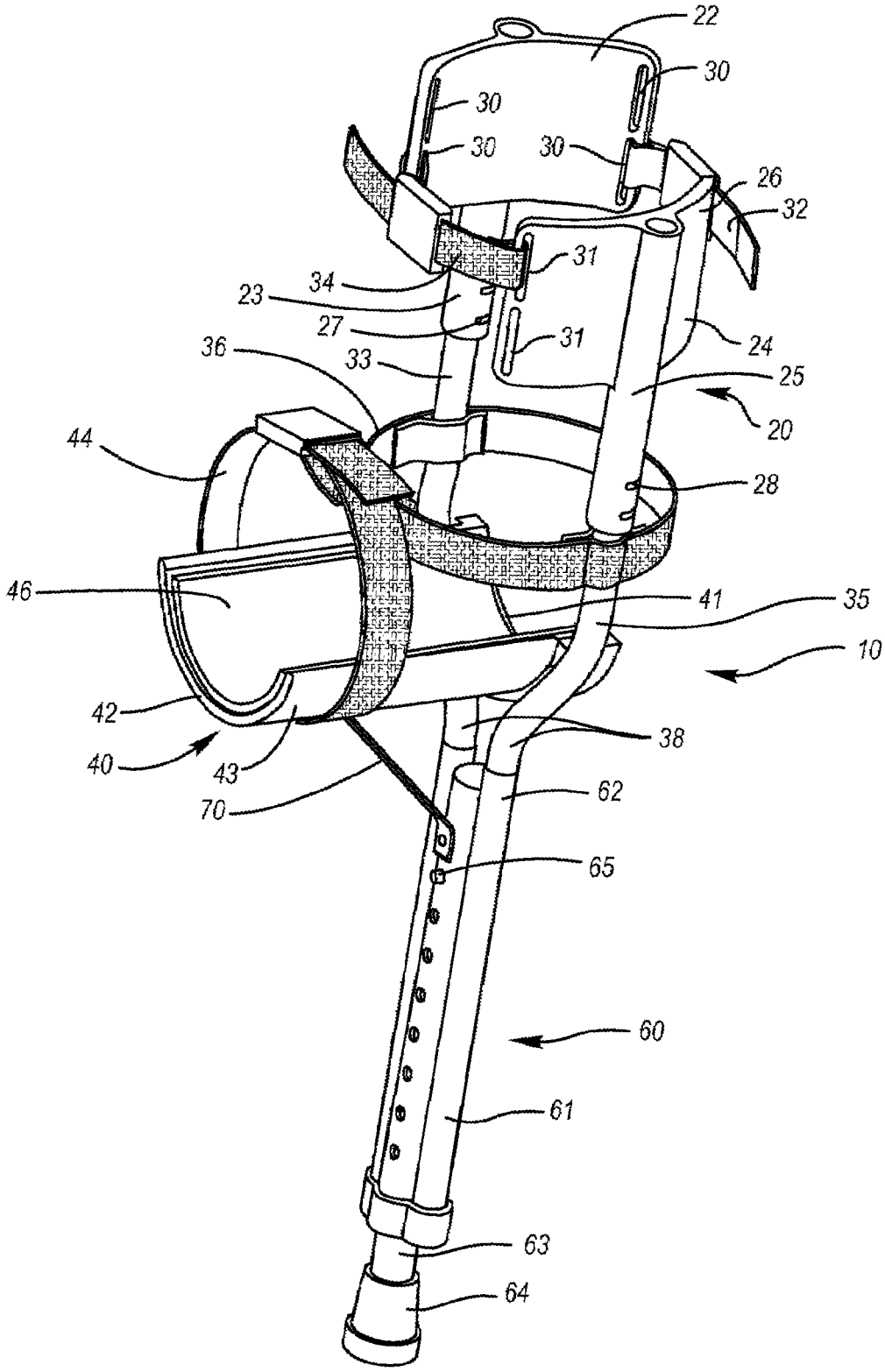
FIG. 1A is a perspective view of a first embodiment of the present invention, shown configured for wearing on a user's left leg.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims. The disclosure of components, materials, configurations for each embodiment could likewise be utilized on the other embodiment(s).

In the following description and in the figures, like elements are identified with like reference numerals. The use of "or" indicates a non-exclusive alternative without limitation unless otherwise noted. The use of "including" means "including, but not limited to," unless otherwise noted.

The present invention is a mono-crutch for assisting the ambulation of individuals having injured lower extremities.

Figure 1B:
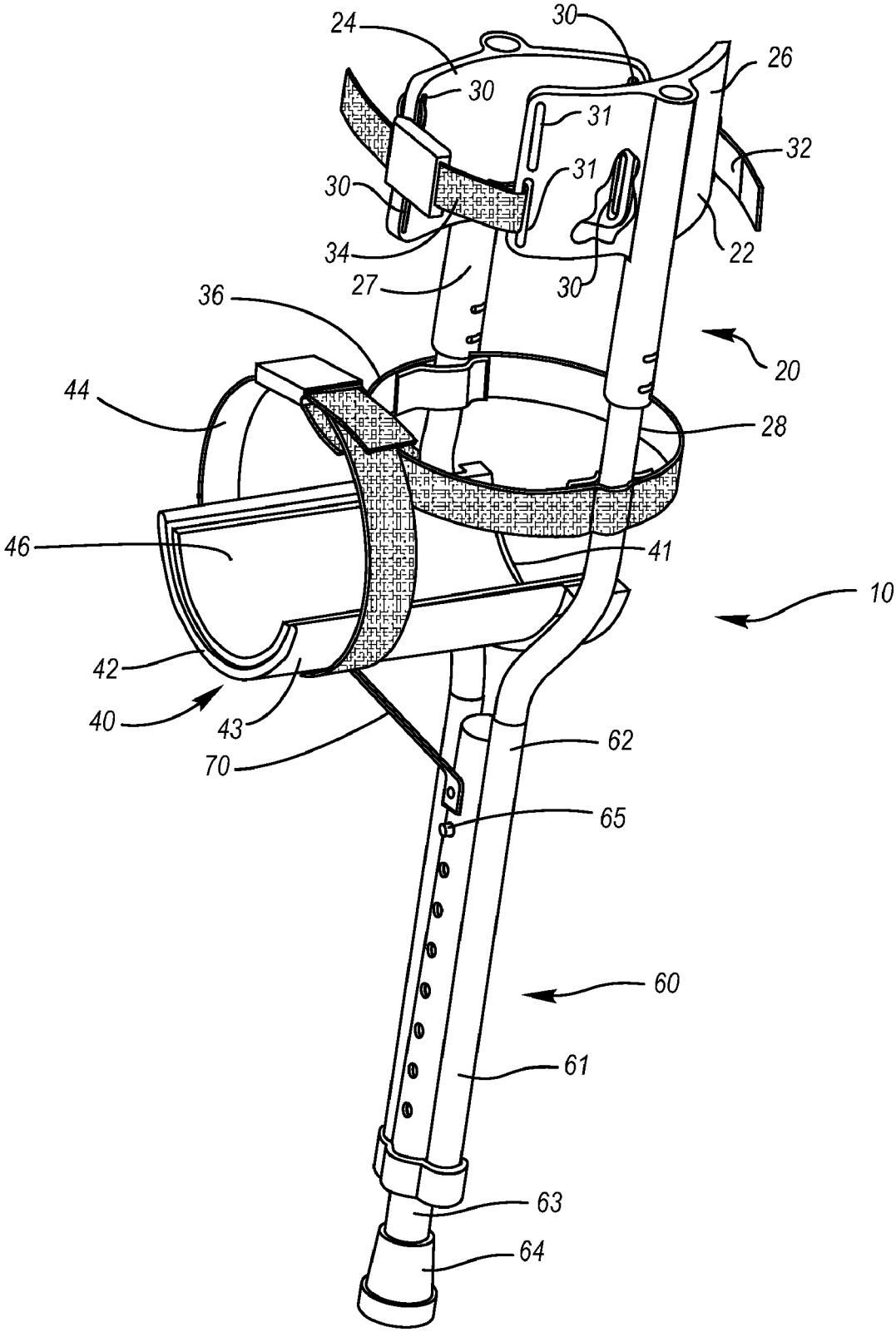
FIG. 1B is a perspective view of the embodiment of FIG. 1A, showing the upper leg support reconfigured so the device can be worn on a user's right leg.

Referring initially to FIGS. 1A and 1B, shown are perspective views of a first embodiment of the present invention. The views showing the device configured for use on a user's left leg (FIG. 1A) and configured for use on a user's right leg (FIG. 1B). The mono-crutch 10 having an upper leg support 20, a lower leg support 40, and a ground contact member 60.

The upper leg support 20 comprising the portion of the present invention configured for attaching to the upper leg portion (thigh) of a user. It is preferred that the upper leg support 20 comprise a pair of thigh pad portions, namely an upper thigh pad portion 22 and a lower thigh pad portion 24. The preferred material for the thigh pad portions being plastic, however other materials would work. The upper thigh pad portion 22 is preferably configured for use on the outside part of a user's leg, and therefore could be referred to as an "outer thigh pad portion," whereas, the lower thigh pad portion 24 is configured for use on the inside portion of a user's leg and therefore could be referred to as the "inner thigh pad portion." It is preferred that the upper and lower thigh pad portions be staggered vertically, e.g., as shown in the drawings, so that at least a portion of the upper thigh pad portion 22 extends vertically above the top or upper end 26 of the lower thigh pad portion. An example staggering would be where the upper end of the upper thigh pad portion is generally around an inch and a half higher than the upper end of the lower thigh pad portion. This staggering arrangement preferably done for any number of reasons, including to increase the lateral and longitudinal stability of the device, to increase control, to make the device more comfortable to wear by a user, for placing the lateral and anti-rotational loads as high on the thigh as possible and remain ambidextrous. The thigh pad portions could be padded, for the comfort of the wearer and/or for assisting a particular wearer in accomplishing an appropriate fit (size adjustments). It is preferred that the lower pad be extended vertically to be oriented just below the user's groin area.

It is preferred that the thigh pad portions (22, 24) themselves have a generally curved or contoured upper surface portion that connects with, and has extending there-from, a tubular portion (23, 25). This tubular portion (23, 25) configured for telescoping engagement with a mating tubular portion (33, 35) of the upper leg support 40. The preferred material for the tubular portion(s) is aluminum tubing, however other materials would likewise be suitable.

Through use of a plurality of a releasable adjustments (27, 28), the height of the upper leg supports (23, 25) can be adjusted upwards or downwards by releasing the releasable adjustment and sliding the mated tubular portions relative to one another. The releasable adjustments shown in these figures comprising spring loaded pins which extend through mating holes through the outermost telescoping tube. Other types of releasable adjustments, including but not limited to mechanical fasteners would also work. Allowing the thigh pad portions to be easily adjustable upwards or downwards allows the present invention to be used on individuals of various statures and body shapes more easily.

The device could also be configured so that the upper ends of the thigh pad portions are further apart than their lower ends. This allows the device to be utilized by an individual having a larger than average length thigh/upper leg portion. In example, the tubes of the upper portion could be splayed slightly outward, with the upper ends further apart than the lower ends. This may result in a configuration roughly equivalent to the change in diameter of an average person's thigh/leg. In doing so, the thigh pad portions will be more comfortable to some users. This separation also accommodates bigger/taller individuals.

It is preferred that the curved portion of the thigh pads be provided with connectors (30, 31) for allowing a releasable connector, such as an adjustable strap with releasable buckle, to be connected thereto. In example, shown in FIGS. 1A/1B are a front strap 32 and a rear strap 34. These straps (32, 34) being adjustable and preferably easily releasable so that user can easily attach and detach upper leg support to their upper leg portion, as well as configure how the device "fits" (tightness, comfort, etc.). The straps could be made of any suitable materials, including but not limited to nylon straps with plastic buckles, hook and loop style fasteners, etc. The straps disclosed herein could be continuous (one-piece), have traction/stops to prevent structure and pads from skidding together in the front or back, include buckles on the front and/or back sides, etc.

It is preferred that the thigh pad portions be provided with a plurality of connectors (30, 31), such as the slots shown. Providing a number of different connectors allows the fasteners (e.g., straps) to be adjusted upwards or downwards for user comfort and for entering into alternative configurations. For instance, one alternative configuration is shown in the difference between FIG. 1A and FIG. 1B. FIG. 1A showing the embodiment configured for wearing on a left leg of a user, whereas FIG. 1B shows the embodiment configured for wearing on a right leg of a user. In this example, to convert from the configuration of FIG. 1A and FIG. 1B, a user would release the releasable adjustments (27, 28) and disconnect the tubular portions (23, 25) of the upper leg support 20 from the tubular portions (33, 35) of the upper leg support 20. Rotation of the disconnected portion generally one-hundred and eighty degrees would then allow the tubular portions (23, 25) of the upper leg support 20 to be reconnected to the tubular portions (35, 33) of the upper leg support. Upon reengagement of the releasable adjustments (27, 28), the conversion to the alternative configuration would be complete.

Alternatively and/or in another embodiment, this switch from left to right could be merely accomplished by the lowering of the upper (outer) thigh pad portion relative to the lower (inner) thigh pad portion (with or without at the same time raising the lower thigh pad portion). In doing so, the upper (outer) becomes the lower (inner) and the lower (inner) becomes the upper (outer). Further, by providing a plurality of the thigh pad connectors (slots) (30, 31), reconfiguring the way the straps engage the slots (moving some straps to higher connectors, some to lower), the transformation from "left" to "right" (or vice versa) would be complete.

It is further envisioned that at least one lower releasable attachment 36 (such as the strap and buckle shown) be provided. This lower releasable adjustment 36 allowing the lower end of the upper leg support to be securely affixed to the lower portion of a user's upper leg portion, for instances generally above the user's knee. The lower releasable adjustment 36 have a foreword portion 37 configured for extending above the knee of a wearer, allowing the releasable adjustment 36 to be securely attached to the wearer's upper leg portion (thigh) just above the knee.

In this embodiment, extending generally perpendicular to the upper leg support 20 is the lower leg support 40. While "generally perpendicular" is preferred, it is possible for at least a small obtuse angle to exist between the orientation of the lower leg support and the upper leg support, resulting in the upper leg support extending slightly frontwards at its periphery (the upper ends of the thigh pad portions). Additionally, this angle could be adjustable to a wearer's desires, or even the perpendicular connection could be releasable thereby allowing the user to straighten his/her leg, for instance if in a reclining position.

The lower leg support 40 comprising a contoured support 42 configured for receiving therein a portion of a user's lower leg (e.g., the shin portion of a user's lower leg). The contoured support 42 having a front end 41 extending to a rear end 43. It is preferred that a padded insert 46 (e.g., natural padding, synthetic padding, gel type padding, closed cell foam padding) be provided within the contoured support for enhancing a user's comfort when wearing the device 10. This padded insert configurable/replaceable to accommodate lower leg casts and braces. It is preferred that the lower leg support be comprised of wood or plastic, however, other materials would likewise be suitable.

Preferably, a releasable adjustment 44 is provided for allowing the user to attach the lower leg support 40 securely to the user's lower leg. These figures showing the utilization of an adjustable and releasable strap and buckle allowing the lower leg support 40 to be securely attached to the user's lower leg, for instance, preferably at a position right on the user's calf muscle. The lower leg support and releasable adjustment cooperating to rotationally stabilize the device about its vertical axis.

It is preferred that extending downwards from the upper leg support 20 is a ground contact member 60. Alternatively, the ground contact member could extend downwards from the lower leg support. In the embodiment shown in FIGS. 1A and 1B, the ground contact member 60 having an upper portion 62 which is configured for releasable attachment to the lower end 38 of the upper leg support 20. This attachment preferably being fixed. The preferred material for the ground contact member is aluminum; however wood, plastic and other materials would likewise be sufficient.

The ground contact member 60 comprising a first portion 61 and a second portion 63. It is preferred that these two portions (61, 63) be telescopically connected together with suitable adjustment means 65 (spring loaded pin, bolt, nut, screw, other mechanical fastener, etc.) so as to allow the ground contact member 60 to be either lengthened or shortened depending upon the height or desires of the individual using it, thereby aiding in the comfort level of the user. It is preferred that the second portion 63 terminate in a foot piece 64 configured contacting a ground surface. Such foot pieces are commonly known in crutch prior art and can be configured of various materials, including but not limited to rubber. Alternatively, the foot piece could comprise ice studs, laterally disposed feet having two ground contacting portions for lateral control, spring feet, hinged long feet, and hinged shoe holders.

It is preferred that the ground contact member 60 be generally perpendicular to the lower leg support 40. While "generally perpendicular" is preferred, any comfortable angle, whether it be obtuse or acute, could likewise be utilized. It is preferred that a brace 70 be provided for maintaining this a perpendicular relationship, the brace 70 preferably extending between and supporting the rear end 42 of the lower leg support 40 relative to the ground contact member 60. While this is the preferred configuration of the bracing, there could be bracing (triangulation) above or even within the structure of the device itself. In embodiments where the "generally perpendicular" orientation can be modified, the brace would likewise be configured for changing to allow such a change. The preferred brace made of metal, but other materials would likewise be suitable.

Alternatively, the ground contact portion could be retractable, foldable or removable, particularly for adding comfort to a wearer when sitting.

Figure 2:
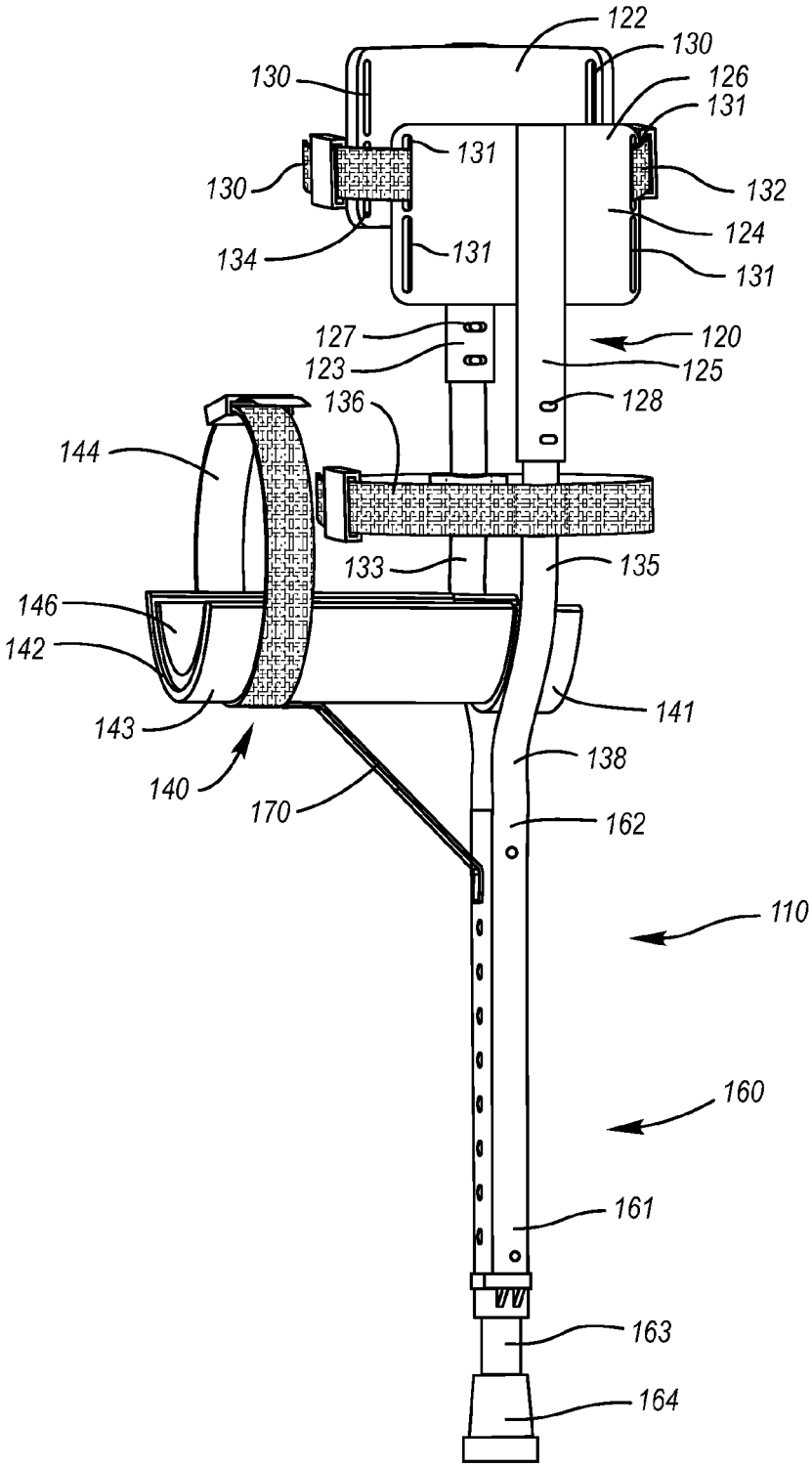
FIG. 2 is the perspective view of a second embodiment of the present invention, shown configured for wearing on a user's left leg.
Figure 3:
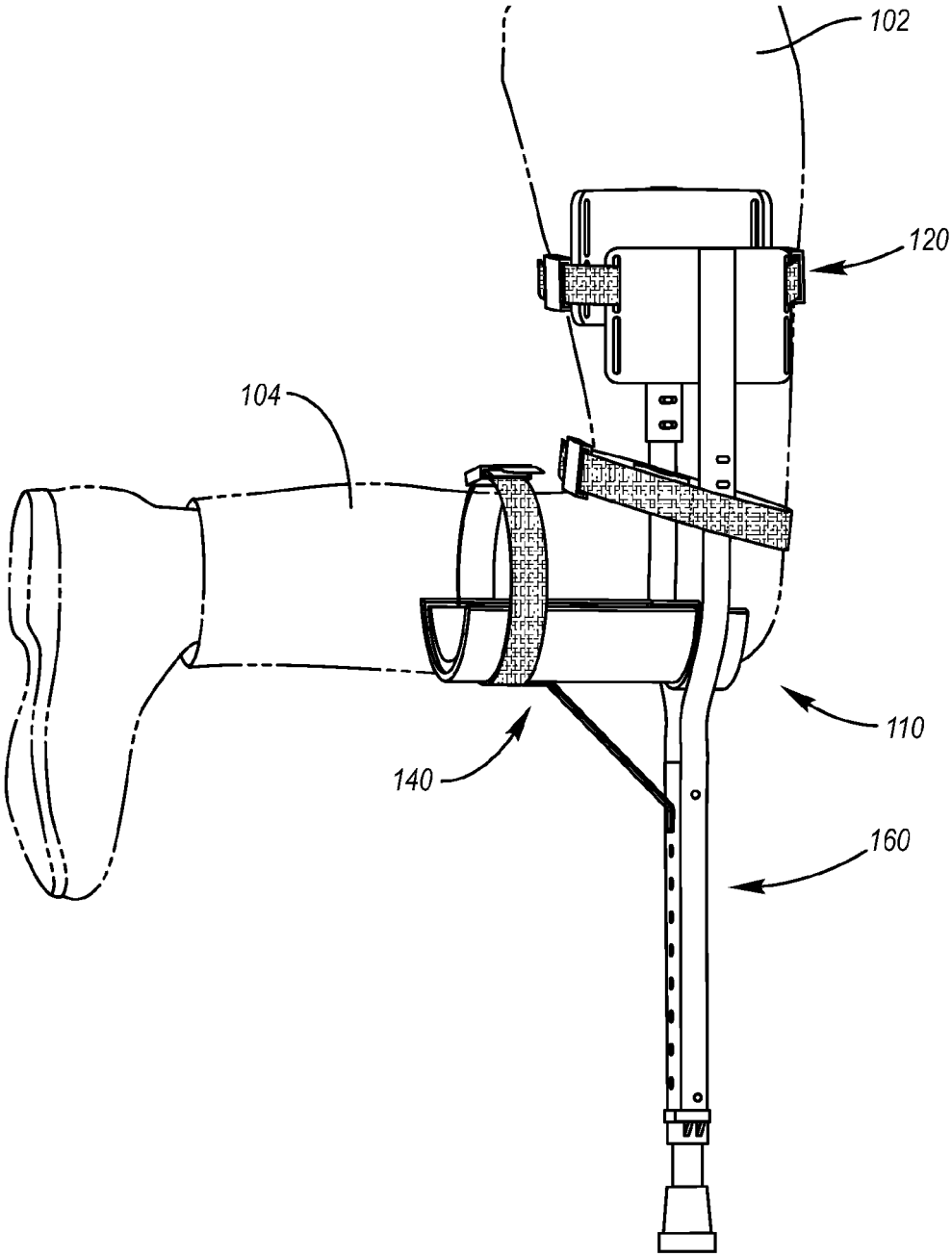
FIG. 3 is an environmental, perspective view of the embodiment of FIG. 2 showing how the mono-crutch would look on a user's left leg.

Referring now to FIGS. 2 and 3, shown is a second embodiment of the invention. FIG. 2 showing a perspective view, FIG. 3 showing a perspective, environmental (as worn) view of the embodiment of FIG. 2. The views showing the device 110 configured for use on a user's left leg. The mono-crutch 110 having an upper leg support 120, a lower leg support 140, and a ground contact member 160.

The upper leg support 120 comprising the portion of the present invention configured for attaching to the upper leg portion (thigh) of a user. It is preferred that the upper leg support 120 comprise a pair of thigh pad portions, namely an upper thigh pad portion 122 and a lower thigh pad portion 124. The upper thigh pad portion 122 is preferably configured for use on the outside part of a user's leg, and therefore could be referred to as an "outer thigh pad portion," whereas, the lower thigh pad portion 124 is configured for use on the inside portion of a user's leg and therefore could be referred to as the "inner thigh pad portion." It is preferred that the upper and lower thigh pad portions be staggered vertically, e.g., as shown in the drawings, so that at least a portion of the upper thigh pad portion 122 extends vertically above the top or upper end 126 of the lower thigh pad portion. This staggering arrangement preferably done to increase the stability of the device as well as making the device more comfortable to wear by a user.

It is preferred that the thigh pad portions (122, 124) themselves have a generally curved or contoured upper surface portion that connects with, and has extending there-from, a tubular portion (123, 125). This tubular portion (123, 125) configured for telescoping engagement with a mating tubular portion (133, 135) of the upper leg support 140. Through use of a plurality of a releasable adjustments (127, 128), the height of the upper leg supports (123, 125) can be adjusted upwards or downwards by releasing the releasable adjustment and sliding the mated tubular portions relative to one another. The releasable adjustments shown in these figures comprising spring loaded pins which extend through mating holes through the outermost telescoping tube. Other types of releasable adjustments, including but not limited to mechanical fasteners would also work. Allowing the thigh pad portions to be easily adjustable upwards or downwards allows the present invention to be used on individuals of various statures and body shapes more easily.

It is preferred that the curved portion of the thigh pads be provided with connectors (130, 131) for allowing a releasable connector, such as an adjustable strap with releasable buckle, to be connected thereto. In example, shown in FIGS. 2 and 3 are a front strap 132 and a rear strap 134. These straps (132, 134) being adjustable and preferably easily releasable so that user can easily attach and detach upper leg support to their upper leg portion, as well as configure how the device "fits" (tightness, comfort, etc.).

It is preferred that the thigh pad portions be provided with a plurality of connectors (130, 131), such as the slots shown. Providing a number of different connectors allows the fasteners (e.g., straps) to be adjusted upwards or downwards for user comfort and for entering into alternative configurations. While such an alternative configuration for this embodiment is not shown in the figures, the alternative configuration of FIGS. 1A/1B could likewise apply to this second embodiment. For instance, to convert from the "left" configuration shown in FIGS. 2 and 3 to a "right" configuration, a user would release the releasable adjustments (127, 128) and disconnect the tubular portions (123, 125) of the upper leg support 120 from the tubular portions (133, 135) of the upper leg support 120. Rotation of the disconnected portion generally one-hundred and eighty degrees would then allow the tubular portions (123, 125) of the upper leg support 120 to be reconnected to the tubular portions (135, 133) of the upper leg support. Upon reengagement of the releasable adjustments (127, 128), the conversion to the alternative configuration would be complete. Alternatively, the spacing and orientation of the connectors and straps could be adjusted.

It is further envisioned that at least one lower releasable attachment 136 (such as the strap and buckle shown) be provided. This lower releasable adjustment 136 allowing the lower end of the upper leg support to be securely affixed to the lower portion of a user's upper leg portion, for instances generally above the user's knee. The lower releasable adjustment 136 have a foreword portion 137 configured for extending above the knee of a wearer, allowing the releasable adjustment 136 to be securely attached to the wearer's upper leg portion (thigh) just above the knee.

In this embodiment, extending generally perpendicular to the upper leg support 120 is the lower leg support 140. While "generally perpendicular" is preferred, it is possible for at least a small obtuse angle to exist between the orientation of the lower leg support and the upper leg support, resulting in the upper leg support extending slightly frontwards at its periphery (the upper ends of the thigh pad portions). Additionally, this angle could be adjustable to a wearer's desires, or even the perpendicular connection could be releasable thereby allowing the user to straighten his/her leg, for instance if in a reclining position.

The lower leg support 140 comprising a contoured support 142 configured for receiving therein a portion of a user's lower leg (e.g., the shin portion of a user's lower leg). The contoured support 142 having a front end 141 extending to a rear end 143. It is preferred that a padded insert 146 be provided within the contoured support for enhancing a user's comfort when wearing the device 110.

Preferably, a releasable adjustment 144 is provided for allowing the user to attach the lower leg support 140 securely to the user's lower leg. These figures showing the utilization of an adjustable and releasable strap and buckle allowing the lower leg support 140 to be securely attached to the user's lower leg, for instance, at a position right on the user's calf muscle.

It is preferred that extending downwards from the upper leg support 120 is a ground contact member 160. Alternatively, the ground contact member could extend downwards from the lower leg support. In the embodiment shown in FIGS. 2 and 3, the ground contact member 160 having an upper portion 162 which attaches to the lower end 138 of the upper leg support 120. As with any embodiment, the ground contact member and the upper portion could form the same general member or parts of the same member. As such, any disclosure of such a configuration herein is intended to include such additional combinations and renditions.

The ground contact member 160 comprising a first portion 161 and a second portion 163. It is preferred that these two portions (161, 163) be telescopically connected together with a suitable adjustment means 165 (spring loaded pin, bolt, nut, screw, other mechanical fastener, etc.) so as to allow the ground contact member 160 to be either lengthened or shortened depending upon the height or desires of the individual using it, thereby aiding in the comfort level of the user. It is preferred that the second portion 163 terminate in a foot piece 164 configured contacting a ground surface. Such foot pieces are commonly known in crutch prior art.

It is preferred that the ground contact member 160 be generally perpendicular to the lower leg support 140. While "generally perpendicular" is preferred, any comfortable angle, whether it be obtuse or acute, could likewise be utilized. It is preferred that a brace 170 be provided for maintaining this a perpendicular relationship, the brace 170 preferably extending between and supporting the rear end 142 of the lower leg support 140 relative to the ground contact member 160. While this is the preferred configuration of the bracing, there could be bracing (triangulation) above or even within the structure of the device itself. In embodiments where the "generally perpendicular" orientation can be modified, the brace would likewise be configured for changing to allow such a change. The preferred brace made of metal, but other materials would likewise be suitable.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

What is claimed is:

1. A mono-crutch for lower leg disability, said mono-crutch for attaching to and supporting a user's leg, the user's leg having an upper leg portion and a lower leg portion, said mono-crutch comprising:

an upper leg support for attachment to said user's upper leg portion, said upper leg support comprising a pair of opposing thigh pad portions, namely an upper thigh pad portion and a lower thigh pad portion, said lower thigh pad portion having an upper end, said thigh pad portions vertically staggered relative to one another so that at least a portion of said upper thigh pad portion extends vertically higher than the upper end of said lower thigh pad portion, said upper leg support further comprising at least one releasable adjustment for attaching said upper leg support to said user's upper leg portion;

a lower leg support for attachment to said user's lower leg portion, said lower leg support comprising at least one contoured support for cradling said user's lower leg portion, said lower leg support comprising at least one releasable adjustment for attaching said lower leg support to said user's lower leg portion; and a ground contact member for contacting a ground surface, said ground contact member generally perpendicular to said lower leg support, said ground contact member having an upper portion configured for attachment to said upper leg support.

2. The mono-crutch of claim 1, wherein said upper and lower thigh pad portions adjustably attach to said upper leg support, thereby allowing said thigh pad portions to be raised and lowered relative to one another so that the mono-crutch to be reconfigured to be used on a user's left leg or right leg.

3. The mono-crutch of claim 1, wherein said upper thigh pad portion and said lower thigh pad portion can be detached from said upper leg support and interchanged for one another, thereby allowing the mono-crutch to be used on a user's left leg or right leg.

4. The mono-crutch of claim 1, wherein said upper thigh pad portion can be lowered and said lower thigh pad portion raised relative to one another so that the upper thigh pad portion is lower than the lower thigh pad portion, and allowing the mono-crutch to be used on a user's left leg or right leg.

5. The mono-crutch of claim 1, wherein at least one of said thigh pad portions adjustably attaches to said upper leg support, thereby allowing the vertical height of the thigh pad portion to be adjusted.

6. The mono-crutch of claim 1, wherein said thigh pad portions comprise connectors for connecting with said releasable adjustment.

7. The mono-crutch of claim 6, wherein multiple connectors are provided on at least one of said thigh pad portions for allowing greater customization by a user.

8. The mono-crutch of claim 1, wherein said releasable attachment for attaching said upper leg support to said user's upper leg portion comprises a front strap and a rear strap interconnecting said thigh pad portions.

9. The mono-crutch of claim 1, wherein said upper thigh pad portion further comprises a lower releasable adjustment for attaching said upper leg support to said user's upper leg portion adjacent a user's knee.

10. The mono-crutch of claim 1, wherein said lower leg support member's contoured support comprises a padded insert.

11. The mono-crutch of claim 1, wherein said lower leg support member has a front end extending to a rear end, wherein said lower leg support member attaches to said upper leg support adjacent said front end.

12. The mono-crutch of claim 1, wherein said ground contact member comprises a first portion telescopically connected with a second portion and an adjustment portion allowing the two portions to be locked relative to one another at a height desired by said user.

13. The mono-crutch of claim 12, wherein said second portion comprises a foot piece for contacting a ground surface.

14. The mono-crutch of claim 1, wherein said ground contact member comprises a foot piece for contacting a ground surface.

15. The mono-crutch of claim 1, further comprising a brace connection fixing the ground contacting portion and the lower leg support generally perpendicular to one another.

16. A mono-crutch for lower leg disability, said mono-crutch for attaching to and supporting a user's leg, the user's leg having an upper leg portion and a lower leg portion, said mono-crutch comprising:

an upper leg support for attachment to said user's upper leg portion, said upper leg support comprising a pair of opposing thigh pad portions, namely an upper thigh pad portion and a lower thigh pad portion, said lower thigh pad portion having an upper end, said thigh pad portions vertically staggered relative to one another so that at least a portion of said upper thigh pad portion extends vertically higher than the upper end of said lower thigh pad portion, said upper leg support further comprising at least one releasable adjustment for attaching said upper leg support to said user's upper leg portion;

a lower leg support for attachment to said user's lower leg portion, said lower leg support comprising at least one contoured support for cradling said user's lower leg portion, said lower leg support comprising at least one releasable adjustment for attaching said lower leg support to said user's lower leg portion; and a ground contact member for contacting a ground surface, said ground contact member generally perpendicular to said lower leg support, said ground contact member having an upper portion configured for attachment to said upper leg support;

wherein said upper thigh pad portion and said lower thigh pad portion can be detached from said upper leg support and interchanged for one another, thereby allowing the mono-crutch to be used on a user's left leg or right leg.

17. The mono-crutch of claim 16, wherein at least one of said thigh pad portions adjustably attaches to said upper leg support, thereby allowing the vertical height of the thigh pad portion to be adjusted.

18. The mono-crutch of claim 16, wherein said ground contact member comprises a first portion telescopically connected with a second portion and an adjustment portion allowing the two portions to be locked relative to one another at a height desired by said user.

19. The mono-crutch of claim 16, further comprising a brace connection fixing the ground contacting portion and the lower leg support generally perpendicular to one another.

20. A mono-crutch for lower leg disability, said mono-crutch for attaching to and supporting a user's leg, the user's leg having an upper leg portion and a lower leg portion, said mono-crutch comprising:

an upper leg support for attachment to said user's upper leg portion, said upper leg support comprising a pair of opposing thigh pad portions, namely an upper thigh pad portion and a lower thigh pad portion, said lower thigh pad portion having an upper end, said thigh pad portions vertically staggered relative to one another so that at least a portion of said upper thigh pad portion extends vertically higher than the upper end of said lower thigh pad portion, said upper leg support further comprising at least one releasable adjustment for attaching said upper leg support to said user's upper leg portion, wherein at least one of said thigh pad portions adjustably attaches to said upper leg support, thereby allowing the vertical height of the thigh pad portion to be adjusted, wherein said upper thigh pad portion and said lower thigh pad portion can be raised and lowered relative to one another, thereby allowing the mono-crutch to be used on a user's left leg or right leg;

a lower leg support for attachment to said user's lower leg portion, said lower leg support comprising at least one contoured support for cradling said user's lower leg portion, said lower leg support comprising at least one releasable adjustment for attaching said lower leg support to said user's lower leg portion;

a brace connection fixing the ground contacting portion and the lower leg support generally perpendicular to one another; and a ground contact member for contacting a ground surface, said ground contact member generally perpendicular to said lower leg support, said ground contact member having an upper portion configured for attachment to said upper leg support, wherein said ground contact member comprises a first portion telescopically connected with a second portion and an adjustment portion allowing the two portions to be locked relative to one another at a height desired by said user.

* * * * *